US005411429A

United States Patent [19]

Klawiter

[11] Patent Number: 5,411,429

[45] Date of Patent: May 2, 1995

[54] LIGHT DISPLAY APPARATUS FOR A CHILD'S TOY

[75] Inventor: Ronald R. Klawiter, Berger, Mo.

[73] Assignee: Handi-Pac, Inc., Hermann, Mo.

[21] Appl. No.: 196,949

[22] Filed: Feb. 15, 1994

[51] Int. Cl.[6] ..... A63H 33/26

[52] U.S. Cl. ..... 446/242; 446/439; 446/484

[58] Field of Search ..... 446/236, 237, 242, 431, 446/438, 439, 448, 484, 485; 40/431–433

[56] References Cited

U.S. PATENT DOCUMENTS

| | | | |
|---|---|---|---|
| 1,313,848 | 8/1919 | Drummond . | |
| 1,960,618 | 5/1934 | Compare . | |
| 2,055,777 | 9/1936 | Shigley . | |
| 3,325,940 | 6/1967 | Davis . | |
| 4,929,212 | 5/1990 | Li | 446/47 |
| 5,030,160 | 7/1991 | Klawitter | 446/242 |

*Primary Examiner*—Robert A. Hafer

*Assistant Examiner*—Jeffrey D. Carlson

*Attorney, Agent, or Firm*—Polster, Lieder, Woodruff & Lucchesi

[57] ABSTRACT

A light display of the present invention is incorporated in a wheeled toy and is visible through a translucent or transparent cover. The light display includes a rotatable arm and a bracket which rotates on the arm. A generally vertical gear is rotated by movement of the toy and meshes with a pinion gear on the arm to rotate the arm. The light bracket is rotatably mounted on the arm spaced from the pinion gear so that it will orbit in the toy. The light bracket in turn has a pinion gear which meshes with a gear defined by a toothed surface of an opening in the toy. The meshing of the bracket gear with the toothed surface of the opening causes the bracket to rotate. The bracket houses electric light means, a battery, and a centrifugally operated switch. A movable weight, in the form of a bearing, is provided to facilitate closing of the switch even at slow speeds of rotation.

20 Claims, 4 Drawing Sheets

LIGHT DISPLAY APPARATUS FOR A CHILD'S TOY

BACKGROUND OF THE INVENTION

This invention relates to light displays, and in particular to a light display for a child's wheeled push toy.

A light display, which is driven by the turning of a toy's wheel, is described in U.S. Pat. No. 5,030,160, which is incorporated herein by reference. In that patent, the light display is operated when a child turns the toy's wheels, such as by pushing the wheeled toy along a floor. The light display has a centrifugal switch which activates the lights when the display is rotated by its gearing. The light display described in that patent incorporates a planetary gear system which drives the light display. The use of the planetary gear system makes the light display somewhat large. It thus cannot be easily incorporated into smaller toys, except by making the gears smaller. This however would make assembly of the light display into the toys more difficult.

One object of this invention is to provide a simple but highly effective light display apparatus in which electrically operated lamps are rotated in such a way as to produce interesting and aesthetically pleasing displays.

Another object is to provide such a light display which can be operated even when the toy's wheel is rotated slowly.

Another object is to provide such a light display which is small and compact and can be incorporated into small toys.

These and other objects will become apparent to those skilled in the art in light of the following description and accompanying drawings.

SUMMARY OF THE INVENTION

Briefly stated, a wheeled toy includes a body having a chassis and a chassis cover. A translucent cover, through which a light display of the present invention is visible, covers at least a part of the body. An axle is rotatably journaled in the chassis and has ground-engaging wheels mounted at opposite ends of the axle and a vertical, axle gear secured to the axle between the wheels. The chassis cover includes a surface having an opening with a toothed edge defining a chassis gear.

The light display mechanism includes an arm rotatably mounted in the body and a light bracket rotatably mounted on the arm. The arm includes a pinion gear which meshes with the axle gear. The light bracket is rotatably mounted to the arm spaced from the pinion gear. The light bracket includes an electric circuit including at least one electric light, a source of electricity, and a centrifugal switch.

Preferably, the light display mechanism is housed in a well formed in the surface of the chassis. The well includes a wall and a floor. A toothed edge of an opening in the well defines, at an upper part thereof, the chassis gear. The floor includes an opening through which the axle gear extends. A boss is formed in the well floor and receives a shaft. The light display arm includes a boss at one end which is rotatably journaled about the shaft. The arm boss defines the pinion gear which meshes with the axle gear. The arm includes a second boss spaced from the first boss. The second boss receives a shaft about which the light bracket is journaled. Preferably, the light bracket includes a downwardly extending boss which is rotatably journaled about the second boss shaft. The light bracket pinion gear is formed about the boss. A rib extends between the first and second bosses.

The source of electricity is a preferably a battery which is removably secured in a central portion of the light bracket. Preferably, the battery is a flat battery which is retained in a generally horizontal position. The central portion has a wall sized and shaped to surround the battery and fingers which extend inwardly from the top of the wall to retain the battery in the central portion. The wall has at least one gap through which a tool, such as a screw driver, can be passed to remove the battery from the light bracket. The electric light means are held in wells which are formed on outer edges of the central portion.

The switch includes a lever having one end operatively connected to a first terminal of the battery and a second free end moveable into with an electrical conductor operatively connected through the light means to a second terminal of the battery. The lever's free end moves between a first position in which it is spaced from the contact and a second position in which it is in electrical contact with the contact. Centrifugal forces caused by rotation of the bracket force the lever to move from the first position to the second position, An arm defining a channel extends outwardly from the battery retaining wall towards the lever. The channel is substantially closed on its sides to define a tunnel or channel open at a front end in which a ball bearing is slidably received. The ball bearing is forced against the lever by centrifugal forces to enable the switch to be closed even at low rotational speeds. A portion of the arm extends beyond the lever and defines a slot in which the lever is received. The slot defines a wall which prevents excess outward movement of the lever, to retain the ball bearing in the channel.

As can be appreciated, the light display of the present invention reduces the number of gears to the minimum number required to produce a rotating, orbiting body. This enables the light display to be made smaller so that it may be incorporated into smaller structures. The orientation of the battery also facilitates in reducing the overall size of the light display. Further, the use of the ball bearing allows the switch to be closed even when the bracket is being rotated slowly.

DESCRIPTION OF THE PREFERRED EMBODIMENT

Figure 1:
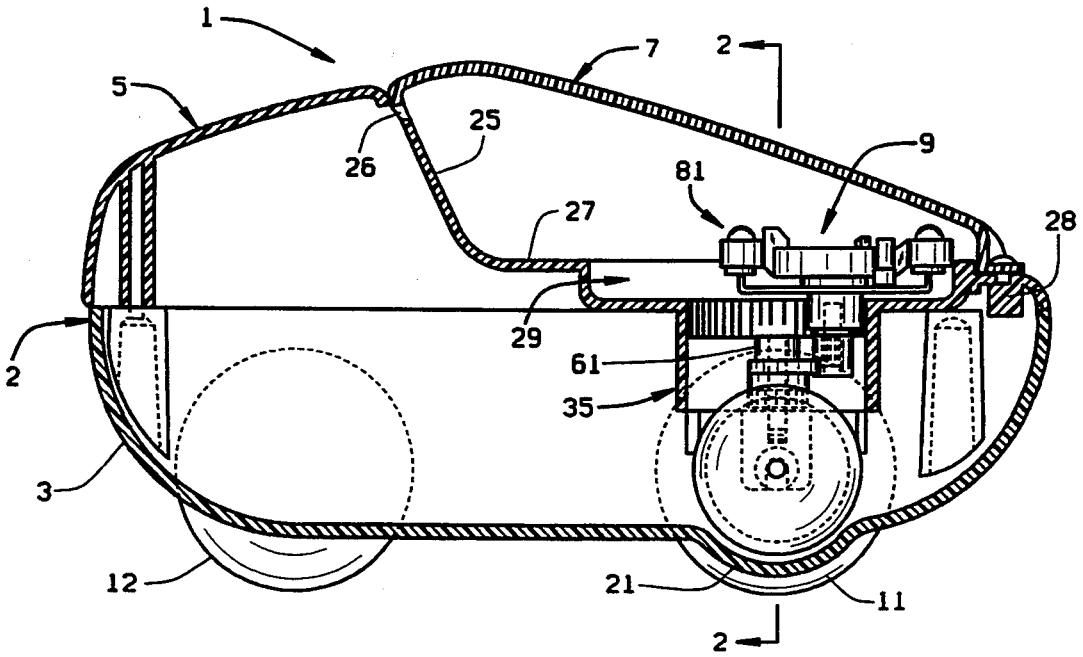
FIG. 1 is a cross-sectional view of a toy car having a light display of the present invention.
Figure 2:
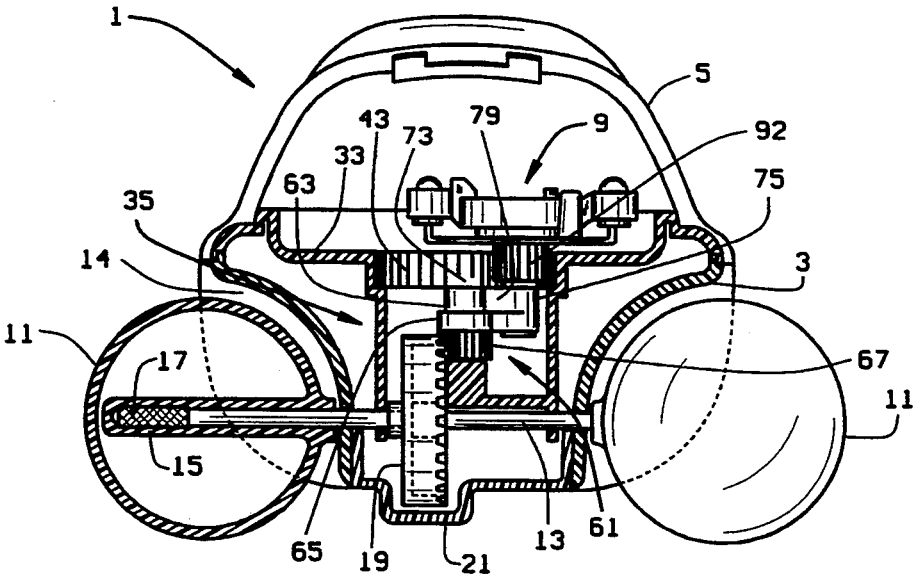
FIG. 2 is a cross-sectional view of the toy car taken along line 2—2 of FIG. 1.

A toy car 1 which incorporates a light display of the present invention is shown generally in FIGS. 1 and 2.

Toy car 1 has a body 2 including a chassis 3 and a cover 5. A transparent or translucent plastic cover 7 encloses the "passenger compartment" of the car 1. A light display 9 is visible through cover 7. Cover 7 may be clear or colored as desired.

A front set 11 and rear set 12 of ground engaging wheels are mounted on axles 13 which extend through the chassis. The wheels are preferably hollow and spherical and reside at least partially in wheel wells 14 formed in the chassis. The axle is received in an inwardly extending hub 15 of the wheel and has a knurled end 17 which holds the axle in the hub. A vertical, driving gear 19 is mounted to the front axle to rotate with the front axle. As described below, gear 19 operates or drives the light display 9. A channel 21 is defined in the bottom of chassis 3 to accommodate gear 19.

Figure 3:
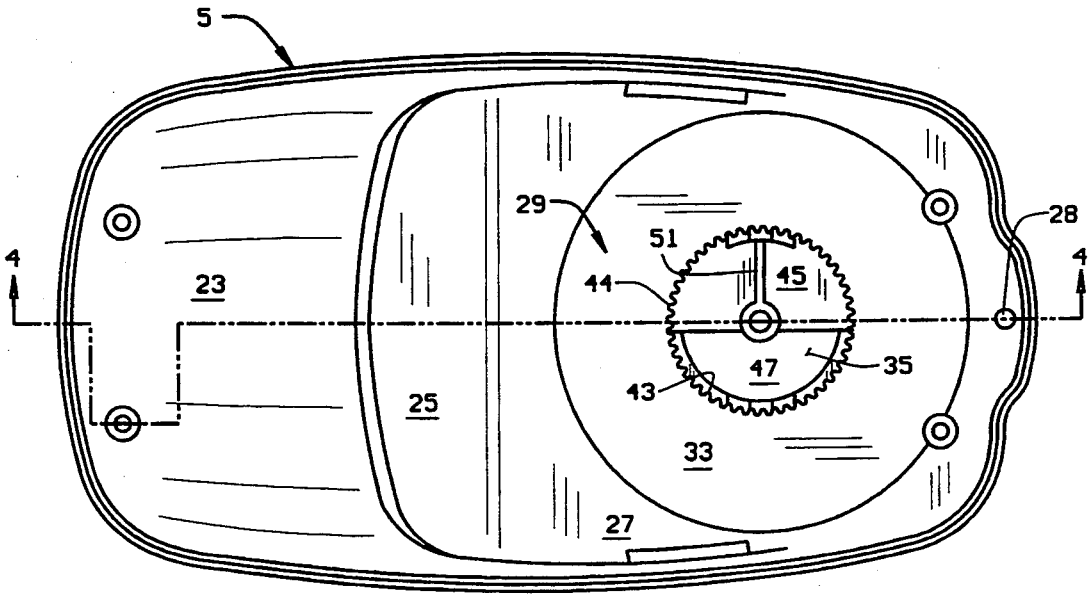
FIG. 3 is a top plan view of a body cover of the toy car.
Figure 4:
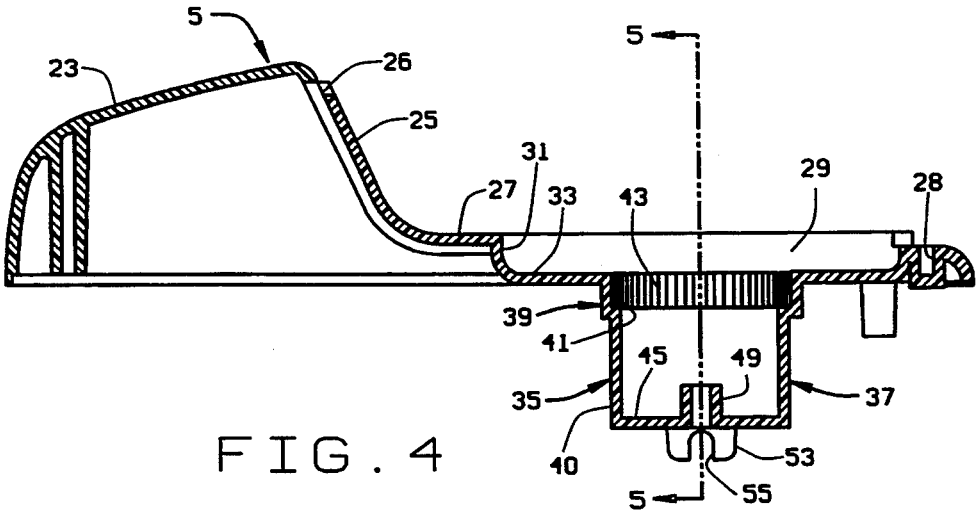
FIG. 4 is a cross-sectional view taken along line 4—4 of FIG. 3.
Figure 5:
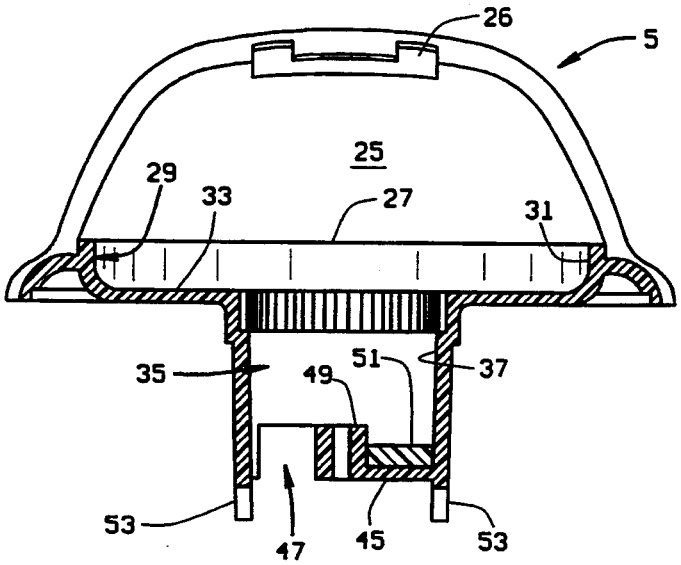
FIG. 5 is a cross-sectional view taken along line 5—5 of FIG. 4.

Turning to FIGS. 3–5, chassis cover 5 includes a back section 23 have a forward wall 25 which leads to a generally horizontal surface 27. Cover 7 is removably secured to cover 5 so that the display 9 can be accessible. Cover 7 has a prong or finger (not shown) which is received in a gap 26 formed at the top of wall 25. A screw passes through the front of cover 7 into a screw hole 28 defined in a forward end of cover 5.

A shallow well 29 having a side wall 31 and a floor 33 is formed in surface 27. Floor 33 defines a second well 35 which is concentric with well 29. Well 35 has a wall 37 having an upper portion 39 and a lower portion 40. Upper portion 39 is wider than lower portion 40 and has an inner surface 41 having a plurality of teeth 43 defining a gear 44. Well 35 has a partial floor 45 which, with wall 37, defines an opening 47 through which gear 19 extends. A boss 49 extends upwardly from floor 45 in the center of well 35. A rib 51 extends from wall 37 to boss 49. Wall 37 also has two oppositely disposed ears 53 extending downwardly from a bottom surface of floor 45. The ears have slots 55 formed therein which snappingly receive axle 13 to rotationally hold the axle in the cover 5.

Figure 6:
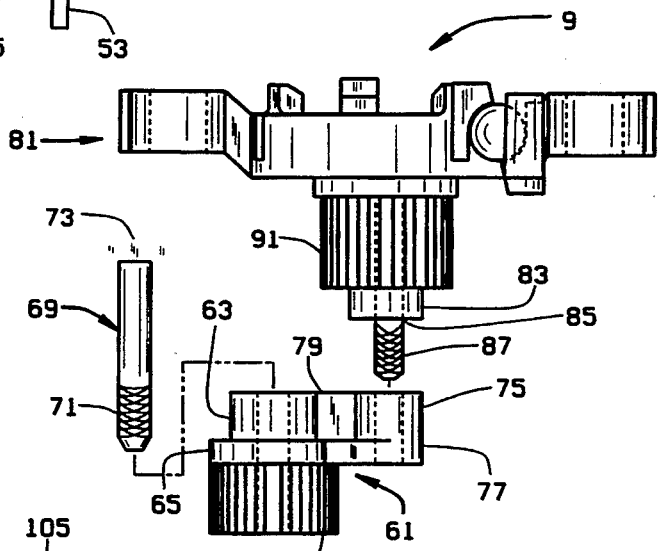
FIG. 6 is an exploded view of the light display.

Turning to FIG. 6, display 9 includes a support arm 61 and a light bracket 81. Support arm 61 is rotatably mounted to body 2 in well 35. Arm 61 has a boss 63 formed at a first end of the arm which extends above and below the arm. The bottom portion of boss 63 defines a toothed gear 67 which meshes with gear 19. Arm boss 63 receives a shaft 69 which is received in well boss 49 to rotatably mount arm 61 to body 2. Preferably, shaft 69 has a knurled bottom end 71 to rotationally fix shaft 69 with respect to well boss 49. Shaft 69 extends through arm boss 63 and has a head 73 at the top thereof which prevents upward movement of the arm on shaft 69. A second boss 75 is formed at an end 77 of arm 61 remote from boss 63. A rib 79 extends between bosses 63 and 75. The top of rib 79 is preferably level with the top surfaces of bosses 63 and 69. Second boss 75 has a top surface approximately level with the top of the lower portion 40 of wall 37. As can be appreciated, when wheel 11 is turned to rotate gear 19, support arm 61 rotates in the well 35 so that boss 75 will orbit near wall 37.

Light bracket 81 is rotatably mounted to arm boss 75 so that it may both rotate and orbit in well 29. Turning to FIGS. 7–10, bracket 81 includes a downwardly extending boss 83 formed centrally of bracket 81. Boss 83 rotatably receives a shaft 85 which, in turn, is received in arm boss 75. Preferably, shaft 85 has a knurled bottom end 87 which will rotationally fix shaft 85 in arm boss 75. Shaft 85 extends through bracket boss 83 and, like shaft 69, has a head which prevents bracket 81 from lifting off of shaft 85. Bracket 81 thus can freely rotate about shaft 85.

Boss 83 has a toothed outer surface 91 defining a gear 92 which meshes with the toothed surface 43 of well 35. Thus, as arm boss 75 is orbited in well 35, bracket gear 92 meshes with surface 43, causing the bracket to rotate on shaft 85. As can be appreciated, bracket 81, which extends over floor 33 of well 29, will rotate in and orbit about well 29 as wheels 11 are rotated.

Bracket 81 carries, at opposite ends thereof, electric light means 93. Light means 93 are preferably LED's, but can be other forms of electric lights, such as light bulbs, and are received in wells 94. An electric circuit C connects the lights 93 to a source of electricity 95 and has a switch 97. The source of electricity is preferably a battery and switch 97 is preferably a centrifugally operated switch. Because cover 7 is removable, battery 95 is accessible for replacing when necessary. When the battery's charge wears down, cover 7 is easily removed by unscrewing the screw to allow access to the battery.

Bracket 81 preferably has a generally circular mid-section 99 which conforms to the size and shape of the battery. Preferably a small battery, such as a watch battery, is used and is preferably mounted to be generally horizontal. A wall 101 extends upwardly around the periphery of mid-section 99 defining a cage which retains the battery in place. At least a pair of fingers 103, and preferably three fingers 103, extend radially inwardly from the top of wall 101 to hold battery 95 in mid-section 99. A gap 105 is formed in wall 101 to allow access to the battery to facilitate removal and replacement of the battery. A pair of smaller gaps 107 are formed in the wall to allow for placement of an element 109 of the circuit C, as will be described.

Figure 7:
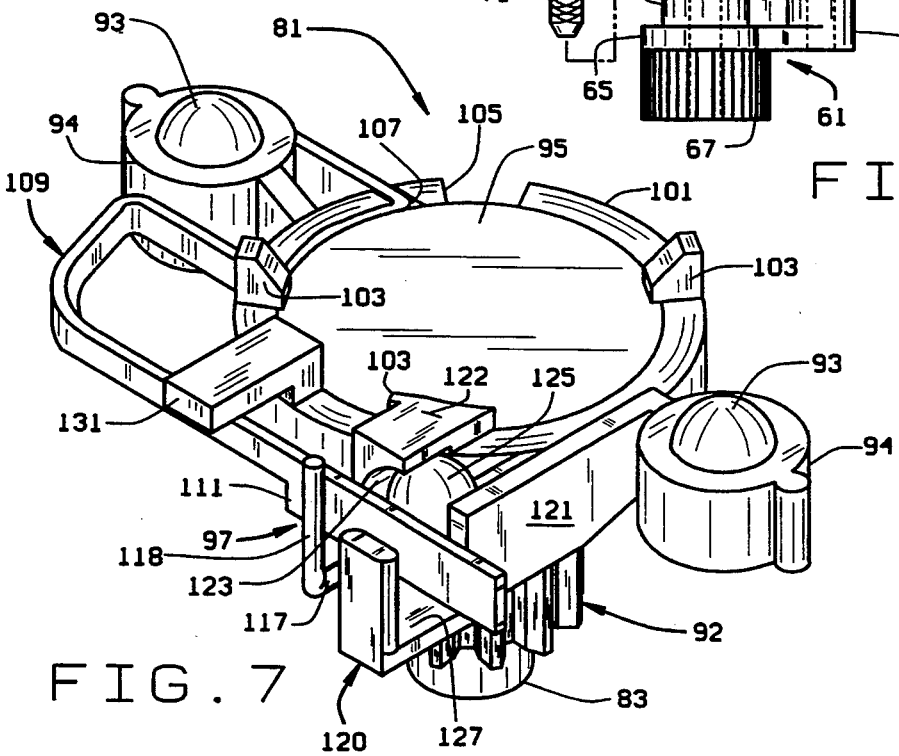
FIG. 7 is a top perspective view of a light bracket of the light display.
Figure 8:
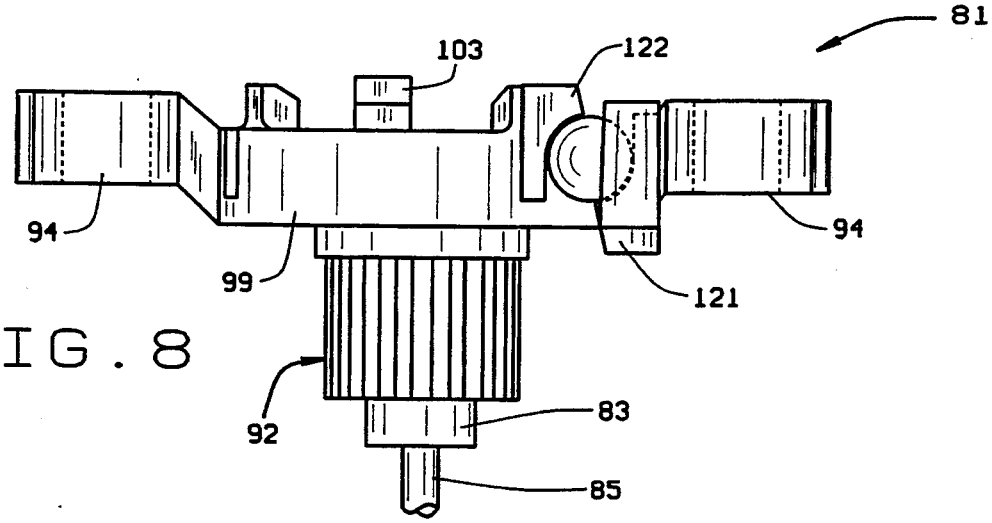
FIG. 8 is a side elevational view of the light bracket.
Figure 9:
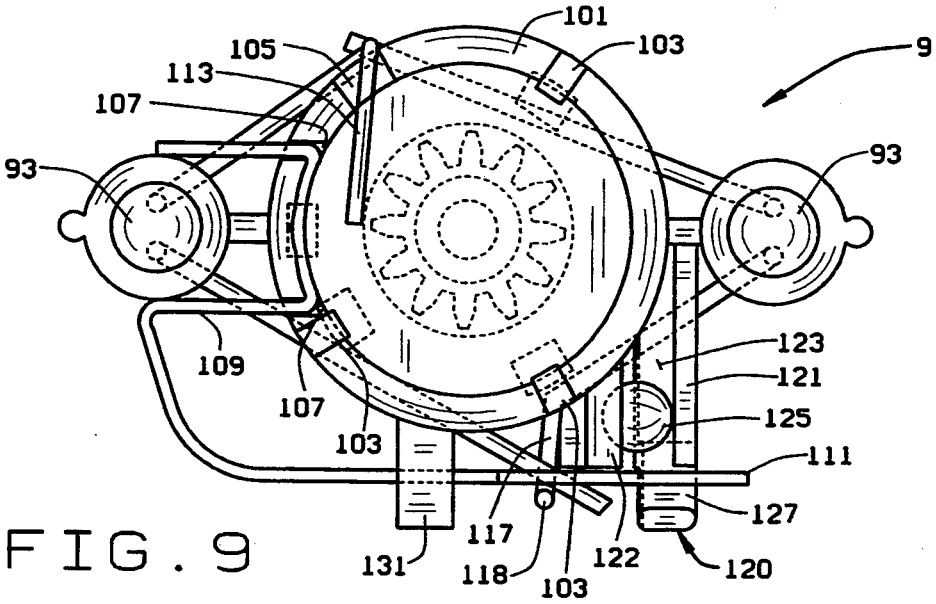
FIG. 9 is a top plan view of the light bracket.
Figure 10:
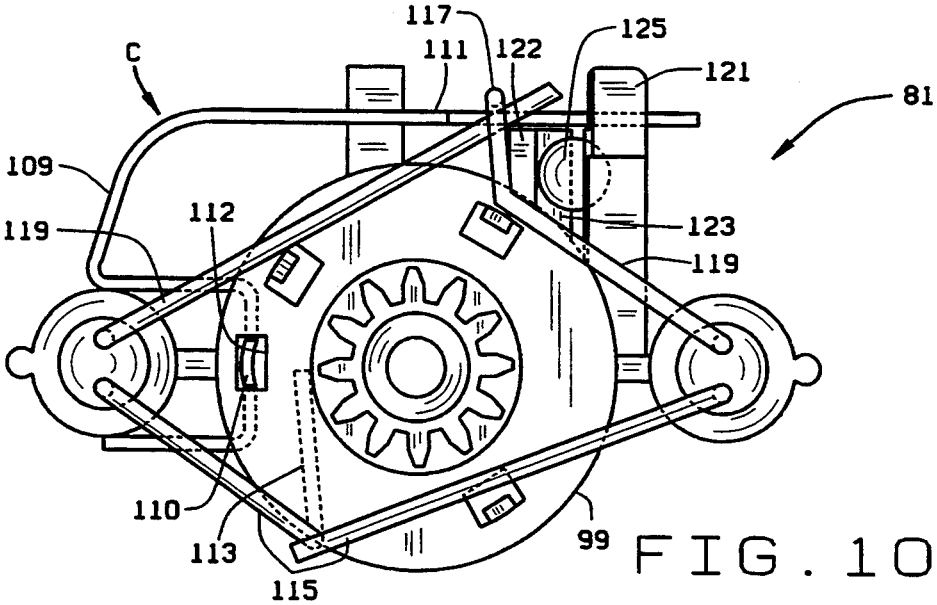
FIG. 10 is a bottom plan view of the light display.

In a watch battery, such as is preferred, the battery has one contact along a bottom surface of the battery and a second contact along the side of the battery. Circuit element 109, which is preferably a thin copper strip, is woven through gaps 107 (best shown in FIG. 9) so that the copper strip may contact the side of the battery, as shown in FIG. 7. The copper element 109 then curves around the mid-section 99 to form a spring lever 111. Copper strip 109 preferably has a downwardly extending tab 110 (FIG. 10) which passes through an opening 112 formed in the floor of mid-section 99 to help fix strip 109 in place.

A wire 113 is placed along the floor of mid-section 99 to be in electrical contact with the battery's first, or bottom, contact. Wire 113 extends through gap 105 and is bent to pass along the bottom surface of bracket 81 to be connected to first lead wires 115 of lights 93. A second wire 117 is connected to second lead wires 119 of lights 93 and extends out from under bracket 81. Wire 117 is bent upwardly to be spaced slightly radially from lever 111 to define a switch contact 118. As can be appreciated, when lever 111 is moved outwardly under centrifugal forces created by rotation of the bracket to contact wire 117, it closes the circuit C.

Lever 111 is a spring lever and returns to a normal open position when the bracket is not being rotated at a sufficiently high speed. To facilitate operation of switch 97, an arm 120, made of two parts 121 and 122, extends outwardly from wall 101. The inner surfaces of the arm's parts cooperate to define a generally circular passage way or channel 123 which receives a ball bearing or other easily slidable weight 125. Channel 123 is substantially closed along its sides and open at a front end. When bracket 81 is rotated, the centrifugal force created urges the weight to move along path 123 towards lever 111. Because the ball bearing or weight will move outwardly when the bracket 81 rotates slowly, the ball bearing will force the lever against switch contact 118 at lower rates of rotation than the lever would by itself (i.e. without the ball bearing), allowing for the circuit C to be closed at lower rates of rotation than if the ball bearing were absent.

Arm portion 121 extends beyond arm portion 122 and defines a slit 127 which receives lever 111. Slit 127 is wider than lever 111 and allows movement of the lever sufficient to move between a first position wherein the switch 97 is open and a second position wherein the switch is closed. However, the slit is also sized to prevent excess movement of the lever which would allow the ball bearing to come out of channel 123. The use of the ball bearing allows the lights 93 to be lit at lower rotational speeds than would be needed if ball bearing 125 were absent. If ball bearing 125 were absent, speed increasing gears would be required to achieve the same effect. This however would require that the size of the light display 9 be increased. The use of the ball bearing allows small children to operate the light display who may otherwise not be able to move the toy fast enough to activate the display.

A third arm 131 extends outwardly of wall 101. Arm 131 is positioned to be above lever 111 to prevent upward movement of the lever.

As can be appreciated, the light display 9 of the present invention reduces the number of gears to make the light display apparatus smaller. It can thus be used with smaller toys. Further, the display is provided with a weight (i.e. ball bearing 125) which allows for activation of the lights 93 even when the bracket 81 is rotated at a slow rate.

Variations within the appended claims may be apparent to those skilled in the art. For example, the battery may be mounted to be vertical rather than horizontal. Different batteries could be used. The body could define only a single well, rather than a pair of wells. In this case, the bracket would rotate and orbit above a surface which surrounds the single well. More or fewer lights could be provided on bracket 81. These examples are merely illustrative.

I claim:

1. A wheeled toy adapted to be operated by a child, the toy comprising a body having a chassis, a chassis cover, and a translucent cover covering at least a part of said body;

axle rotatably journaled in said chassis;

ground engaging wheels mounted at opposite ends of said axle, said axle being rotationally fixed to said wheels to rotate when said wheels are turned;

a gear fixedly mounted on said axle within said chassis, to be rotated when said wheels are turned;

said chassis cover having a surface defining an opening having a toothed edge defining a chassis gear; said chassis cover surface defining a well including a wall and a floor, said wall defining said chassis gear at an upper part thereof and said floor defining an opening through which said axle gear extends;

a light display mechanism including an arm rotatably mounted in said body and a light bracket rotatably mounted on said arm, said arm including a pinion gear which meshes with said axle gear;

said light bracket being rotatably mounted to said arm at an end thereof spaced from said pinion gear, said light bracket including, a pinion gear in meshing contact with said chassis gear and an electric circuit including at least one electric light means, a source of electricity, and a centrifugal switch, said centrifugal switch being normally open;

whereby, as said wheels are rotated, said axle gear drives said arm pinion gear to cause said light bracket to orbit in said toy, and said light display mechanism is rotated on said arm by the interaction of the light display mechanism pinion gear with said chassis gear, said rotating motion of said light bracket closing said centrifugal switch to close said circuit to light said electric light means.

2. The wheeled toy of claim 1 including a boss in said well floor, said boss receiving a shaft; said light display arm defining a light display arm boss at one end which is rotatably journaled about said shaft, said light display arm boss defining said pinion gear which meshes with said axle gear.

3. The wheeled toy of claim 2 wherein said light display arm includes a second boss spaced from said first boss, said second boss receiving a shaft, said light bracket including a downwardly extending boss which is rotatably journaled about said second boss shaft, said light bracket pinion gear being formed about said second boss.

4. The wheeled toy of claim 3 wherein said light display arm includes a rib extending between said first and second bosses.

5. The wheeled toy of claim 1 wherein said source of electricity is a battery; said light bracket including a central portion sized and shaped to receive said battery and at least one well which receives said at least one electric light means.

6. The wheeled toy of claim 5 wherein said battery is removably received in said central portion; said central portion including a wall sized and shaped to surround said battery and means for retaining said battery in said central portion; said wall defining at least one gap through which a tool can be passed to remove said battery from said light bracket.

7. The wheeled toy of claim 6 wherein said battery is a flat battery.

8. The wheeled toy of claim 7 wherein said battery is generally horizontally secured in said light bracket.

9. The wheeled toy of claim 5 wherein said switch includes a lever having one end operatively connected to a first terminal of said battery and a second free end, and a contact operatively connected to a second terminal of said battery, said lever free end being movable between a first position in which it is spaced from said contact and a second position in which it is in electrical contact with said contact, said lever being moved from said first position to said second position by rotation of said light bracket and one of said lever and said contact being electrically connected to said light means.

10. The wheeled toy of claim 9 including facilitating means for closing said switch at low rotational speeds.

11. The wheeled toy of claim 10 wherein said facilitating means includes a weight.

12. The wheeled toy of claim 11 including an arm extending outwardly from said central portion towards said lever free end, said arm defining a channel, said channel slidably receiving said weight.

13. The wheeled toy of claim 12 wherein said weight comprises a ball bearing.

14. The wheeled toy of claim 13 wherein a portion of said arm extends beyond said lever, said arm defining a slot which receives said lever, said slot defining a wall which prevents excess outward movement of said lever to retain said ball bearing in said channel.

15. A light display apparatus for use with a toy; said toy having a rotatable axle, an axle gear fixed on said axle to rotate with said axle, and a surface defining an opening having a toothed periphery, said toothed periphery defining a surface gear; said light display apparatus including;

a) an arm rotatably mounted in said toy, said arm including an arm pinion gear which meshes with said axle gear; and b) a light bracket rotatably mounted on said arm at an end thereof spaced from said pinion gear, said light bracket including 1) a bracket pinion gear depending from said bracket, said bracket pinion gear being in meshing contact with said surface gear;

2) an electric circuit including at least one electric light, a battery, and a centrifugal switch, said centrifugal switch including a lever movable between a first position in which said circuit is opened and a second position in which said circuit is closed, said lever being moved from said first to said second position by rotation of said light bracket; and 3) an arm extending from said bracket said arm defining:

i) a slot which receives said lever; and ii) a channel which slidably receives a weight; said slot defining a wall which prevents excess outward movement of said lever to retain said weight in said channel.

16. The light display of claim 15 wherein said arm pinion gear defines a point of rotation for said arm; said arm including a boss spaced from said arm pinion gear, said boss receiving a shaft; said bracket pinion gear being rotatably journaled about said shaft, said bracket pinion gear meshing with said surface gear.

17. The light display of claim 15 wherein said switch includes a lever operatively connected to a first terminal of said battery and a contact operatively connected to a second terminal of said battery; said lever including a fixed end and a free end, said lever free end being movable between said first position in which it is spaced from said contact and said second position in which it is in electrical contact with said switch contact.

18. A light display apparatus for use with a toy having a rotatable axle, a gear fixed on said axle to rotate with said axle; and a surface defining a opening having a toothed periphery, said toothed periphery defining a surface gear; said light display apparatus including an arm rotatably mounted in said toy and a light bracket rotatably mounted on said arm;

said arm including a pinion gear which meshes with said axle gear;

said light bracket being rotatably mounted to said arm at an end thereof spaced from said pinion gear and including a pinion gear in meshing contact with said surface gear and an electric circuit having at least one electric light means, a battery, and a centrifugal switch;

said switch including a lever having one end operatively connected to a first terminal of said battery and a second free end and a contact operatively to a second terminal of said battery, said lever free end being movable between a first position in which it is spaced from said contact and a second position in which it is electrical contact with said contact, said lever being moved from said first position to said second position by rotation of said light bracket;

an arm extending outwardly from a central portion of said light bracket towards said lever free end, said arm defining a channel, said channel slidably receiving a weight, said weight being urged toward said lever free end when said bracket is rotated to facilitate closing of said switch at low rotational speeds; a portion of said arm extending beyond said lever, said arm defining a slot which receives said lever, said slot defining a wall which prevents excess outward movement of said lever to retain said weight in said channel.

19. A rotatable light bracket for a centrifugally operated light display, said light bracket including:

an electric circuit including at least one electric light means;

a battery;

a centrifugal switch, said centrifugal switch being normally open; said switch including a lever having one end operatively connected to a first terminal of said battery and a second free end and a contact operatively connected to a second terminal of said battery, one of said lever and said contact being electrically connect to said light means; said lever free end being movable between a first position in which it is spaced from said contact and a second position in which it is in electrical contact with said contact, said lever being moved from said first position to said second position by rotation of said light bracket; and means for facilitating operation of said switch low speeds of rotation including a weight which is urged towards said when said is rotated to close said switch:, an arm extending outwardly from said central portion towards said lever free end, said arm defining a channel, said channel slidably receiving said weight; a portion of said arm extending beyond said lever, said arm defining a slot which receives said lever, said slot defining a wall which prevents excess outward movement of said lever to retain said weight in said channel.

20. The rotatable light bracket of claim 19 wherein said weight comprises a ball bearing.

* * * * *